US008656880B2

(12) United States Patent
Makarov et al.

(10) Patent No.: US 8,656,880 B2
(45) Date of Patent: Feb. 25, 2014

(54) OPTIMIZATION OF THE EXCITATION FREQUENCY OF A RADIOFREQUENCY PLUG

(75) Inventors: Maxime Makarov, Viroflay (FR); Frederic Auzas, Paris (FR)

(73) Assignee: Renault S. A. S., Boulogne-Billancourt (FR)

( * ) Notice: Subject to any disclaimer, the term of this patent is extended or adjusted under 35 U.S.C. 154(b) by 769 days.

(21) Appl. No.: 12/919,906

(22) PCT Filed: Feb. 19, 2009

(86) PCT No.: PCT/FR2009/050264

§ 371 (c)(1),
(2), (4) Date: Nov. 18, 2010

(87) PCT Pub. No.: WO2009/112731

PCT Pub. Date: Sep. 17, 2009

(65) Prior Publication Data

US 2011/0048355 A1 Mar. 3, 2011

(30) Foreign Application Priority Data

Feb. 28, 2008 (FR) ..... 08 51276

(51) Int. Cl.
*F02P 23/00* (2006.01)
*F02P 9/00* (2006.01)
*F02B 19/00* (2006.01)

(52) U.S. Cl.
USPC ..... 123/143 B

(58) Field of Classification Search
USPC ..... 123/143 B, 143 R, 598, 620, 606, 626; 315/111.21, 111.51
See application file for complete search history.

(56) References Cited

U.S. PATENT DOCUMENTS

| | | | | |
|---|---|---|---|---|
| 5,179,928 | A | 1/1993 | Cour et al. | |
| 5,568,801 | A | 10/1996 | Paterson et al. | |
| 6,334,302 | B1 * | 1/2002 | Chang-Diaz | 60/203.1 |
| 7,956,543 | B2 * | 6/2011 | Agneray et al. | 315/111.21 |
| 8,342,147 | B2 * | 1/2013 | Nouvel et al. | 123/143 B |
| 2011/0203543 | A1 | 8/2011 | Agneray et al. | |

FOREIGN PATENT DOCUMENTS

| | | | | |
|---|---|---|---|---|
| DE | 10 2004 058925 | | 6/2006 | |
| FR | 2 895 169 | | 6/2007 | |
| JP | 2009174410 | A * | 8/2009 | F02M 27/04 |
| WO | 01 20162 | | 3/2001 | |
| WO | 2007 017481 | | 2/2007 | |

* cited by examiner

*Primary Examiner* — Hieu T Vo
(74) *Attorney, Agent, or Firm* — Oblon, Spivak, McClelland, Maier & Neustadt, L.L.P.

(57) ABSTRACT

A device for generating a radiofrequency plasma, which includes a supply module applying, on an output interface, an excitation signal at a setpoint frequency, adapted for generating a spark at the output of a plasma-generation resonator connected to the output interface of the power module, and a control module supplying the setpoint frequency to the power module upon a command for generating the radiofrequency plasma. The control module is configured to determine an optimal excitation frequency, to adapt the setpoint frequency to the resonance conditions of the device after formation of the spark.

9 Claims, 2 Drawing Sheets

OPTIMIZATION OF THE EXCITATION FREQUENCY OF A RADIOFREQUENCY PLUG

The present invention relates, generally, to radio-frequency plasma spark plugs, intended for the combustion chambers of an internal combustion engine, for a motor vehicle ignition application. The invention relates more particularly to the operation of the radiofrequency high voltage power supply of such a spark plug, based on the resonance phenomenon in an RLC circuit, the resonance frequency of which is determined by intrinsic parameter values of the spark plug.

FIG. 1 illustrates a plasma generation device. This device is provided with a plasma generation resonator 30, representing a first subsystem of the radio-frequency spark plug, and comprising, in series, a resistor $R_0$, an inductor $L_0$ and a capacitor $C_0$, the values of which are set during production by the geometry and the nature of the materials used, so that the resonator has a resonance frequency above 1 MHz.

The device is also provided with a radiofrequency power supply module 20, applying an excitation signal U in the form of a voltage at a setpoint frequency Fc to an output interface to which the plasma generation resonator 30 is connected. A control module 10 supplies the setpoint frequency Fc to the power supply module 20.

In reality, the excitation of a radiofrequency spark plug is not stationary, as illustrated in FIG. 2. In practice, at the instant t_0, the control module sends a plasma generation command (ignition command) to the power supply module, suitable for triggering the excitation of the resonator. The excitation frequency is then close to the resonance frequency of the resonator. At the end of a transitional period, at the instant t_d, the voltage at the output of the resonator becomes sufficiently high for a spark to be formed.

As it happens, the formation of the spark at the output of the resonator, occurring substantially at the moment t_d of the plasma generation command, represents a second subsystem 40 of the radiofrequency spark plug, the parameters of which modify the resonance conditions of the system as a whole. In practice, a spark in a gas, like any electrical conductor, is characterized by a capacitance $C_d$, modeled in FIG. 1 at the output of the radiofrequency resonator 30. Thus, if without spark, it is only the parameters $R_0$, $L_0$ and $C_0$ , specific to the resonator, that determine the resonance frequency of the system, this is no longer the case upon the formation of a spark, since the characteristics specific to said spark in effect modify this resonance frequency.

This difference between the actual resonance frequency of the resonator with a spark formed and the excitation frequency of the resonator set by the power supply module and adjusted for a system without spark then leads to a degradation of the quality factor of the resonator (quality factor defining the ratio between the amplitude of its output voltage and its input voltage).

Thus, by way of example, in a case in which the resonance frequency, specific to the resonator without spark with a quality coefficient greater than 100, is greater than 1 MHz, when the spark is produced, the resonance frequency of the system reduces by several tens of kHz given the additional capacitance associated with the presence of the spark at the output of the resonator, which is sufficient to provoke a drop in the quality coefficient of the order of 25% and therefore lead to a significantly lower efficiency of the radiofrequency spark plug.

Also, this application to motor vehicle ignition requires the use of resonators that have a high quality factor, the excitation frequency of which always remains close to the resonance frequency of the entire system. Thus, it is important to maintain a maximum quality factor for the spark plug resonator throughout its excitation, until the instant t_ext (FIG. 2), at which the control module sends a command to switch off the resonator's radiofrequency power supply.

The patent application FR2895169, filed in the name of the applicant, discloses means which make it possible to optimize the excitation frequency of the resonator.

These means involve incorporating in the radiofrequency power supply of the resonator:

- an interface for receiving a request in determining an optimum excitation frequency, that is to say, substantially equal to the resonance frequency of the resonator,
- an interface for receiving measurement signals of operating parameters of a combustion engine, such as the engine oil temperature, the engine torque, the engine speed, the ignition angle, etc.
- an interface for receiving measurement signals of operating parameters of the radiofrequency power supply, for example the voltage at the output of the resonator, and
- a memory module storing relationships between the engine operating parameter measurement signals, the radiofrequency power supply operating parameter measurement signals and the optimum excitation frequency of the resonator.

Such an embodiment is, however, fairly complex and, consequently, costly to implement.

Furthermore, it does not make it possible to optimize the radiofrequency power supply operating conditions in real time, given that the operating parameter measurements of a combustion engine are slow and supply only average information over a number of cycles and all the cylinders.

Furthermore, the reception of this request takes place during a resonator excitation frequency optimization phase during which the radiofrequency power supply is configured to apply to its output interface a voltage at a setpoint frequency, unsuitable for allowing the generation of plasma from the resonator. In other words, such a system makes it possible to perfectly preset the power supply to the resonance frequency specific to the spark plug without spark, but, on the other hand, does not make it possible to take account of the triggering of the spark which, as has been seen, modifies the resonance conditions to the cost of the efficiency of the spark plug.

This solution therefore involves modifying the voltage at the output of the resonator. In practice, upon the receipt of a request to determine an optimum excitation frequency, the power supply module applies to the output interface a voltage that does not enable the resonator to generate a plasma. Then, once this optimum frequency is determined, the power supply module applies to its output interface a voltage at this optimum frequency, during an operation phase of the plasma generation device, during which a plasma must be generated. Also, this embodiment requires the inclusion of an HV probe at the output of the resonator, which poses a serious technical problem in the case of a motor vehicle spark plug.

The invention aims to resolve one or more of these drawbacks. The invention thus proposes a radiofrequency plasma generation device, comprising a power supply module applying, to an output interface, an excitation signal at a setpoint frequency, suitable for enabling the formation of a spark at the output of a plasma generation resonator connected to the output interface of the power supply module, and a control module, supplying the setpoint frequency to the power supply module in response to a radiofrequency plasma generation command, said device being characterized in that the control module comprises means of determining an optimum excitation frequency, designed to adapt the setpoint frequency to the resonance conditions of the device after formation of the spark.

According to one embodiment, the determination means are suitable for setting the setpoint frequency at a value below the resonance frequency of the resonator without spark.

Preferably, the difference between said set value and the resonance frequency of the resonator without spark is located within a range between 0 and 100 kHz.

According to another embodiment, the determination means are suitable for modulating the setpoint frequency for the duration of the plasma generation command.

For example, the determination means are suitable for successively setting the setpoint frequency at a first value of the order of magnitude of the resonance frequency of the resonator without spark, at the moment when the plasma generation command is triggered, and at a second value reduced by a predetermined frequency step relative to said first value, substantially at the moment of the formation of the spark.

According to a variant, the determination means are suitable for controlling a reduction of the setpoint frequency from a set first value, according to a frequency step that can be adjusted in real time, from the moment of the formation of the spark.

Advantageously, that set first value is of the order of magnitude of the resonance frequency of the resonator without spark.

Advantageously, the device comprises a resonator power supply electrical measuring module connected to the control module, the determination means determining the value of the frequency step according to electrical measurements received.

Preferably, the resonator power supply electrical measuring module is suitable for measuring the relative amplitude of the current at the input of the resonator.

The invention also relates to an internal combustion engine ignition system, characterized in that it comprises at least one plasma generation device as has just been described.

Other features and advantages of the invention will clearly emerge from the description thereof given below, by way of a nonlimiting example, with reference to the appended drawings, in which:

FIG. 1 diagrammatically illustrates a known radiofrequency plasma generation device;

Figure 1:
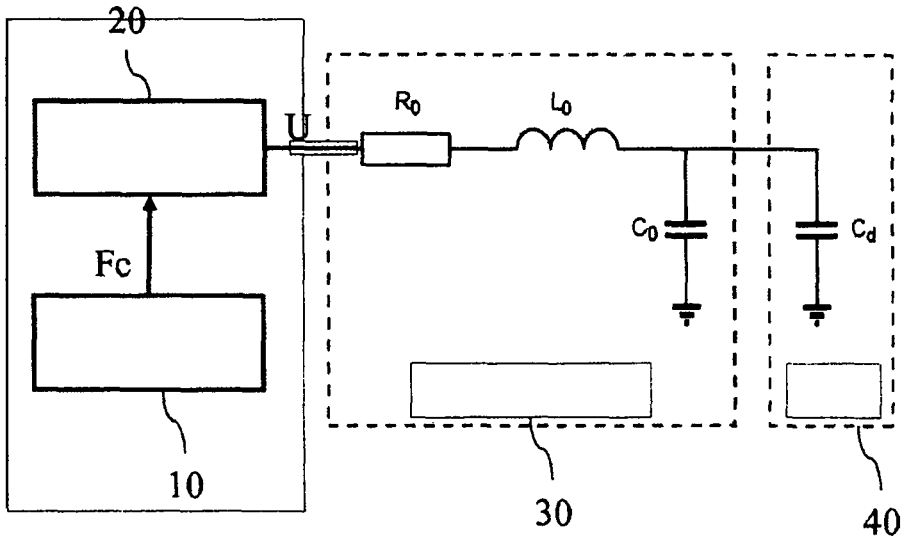
Figure 2:
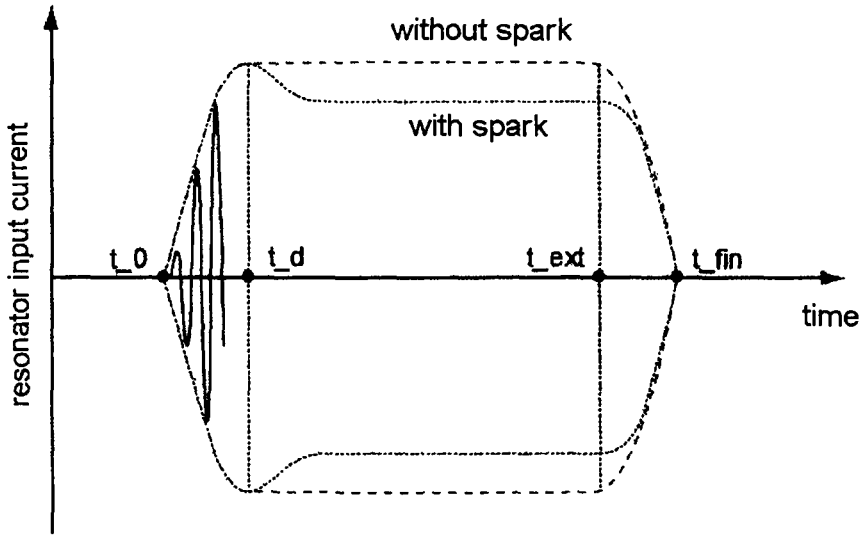
FIG. 2 illustrates the current response of the plasma generation resonator as a function of time in response to a plasma generation command.

The invention proposes adapting in real time the frequency of the excitation signal supplied by the power supply module to the radiofrequency resonator during a plasma generation command, in order to maintain the maximum quality factor of the resonator, including after the triggering of the spark.

To do this, the control module of the plasma generation device according to the invention incorporates means of determining an optimum excitation frequency, designed to adapt the setpoint frequency Fc to the resonance conditions of the device after the formation of the spark.

According to a first embodiment, in order to maintain the maximum quality factor after the triggering of the spark, the setpoint frequency is set at a value below the resonance frequency of the resonator without spark. A choice is therefore made, according to this embodiment, to adjust beforehand the radiofrequency power supply module of the resonator to a lower frequency than the resonance frequency of the resonator without spark to excite the latter. Bearing in mind that, upon the formation of the spark, the natural frequency of the device as a whole typically reduces by several tens of kHz, the control module sets, for example, the setpoint frequency at a value located within a range of between 0 and 100 kHz under the resonance frequency specific to the resonator without spark.

Thus, once the spark is formed, the device is naturally in the optimum operating conditions taking account of the formation of the spark and the quality factor reaches its maximum.

However, that is a passive solution, which requires no additional measurement means, nor any specific control device to be incorporated. On the other hand, given the random variation of the parameters of the actual spark, which directly influence the resonance conditions of the device after the formation of the spark, this solution does not guarantee perfect optimization of the resonance frequency of the device.

Thus, another embodiment involves not setting, once and for all, the setpoint frequency prior to the sending of the plasma generation command at a value that is optimized to take account of the resonance conditions after formation of the spark as has just been seen, but, on the contrary, modulating the setpoint frequency for the duration of the plasma generation command.

According to this embodiment, provision is made to control the power supply module, so that it sends an excitation train to the radiofrequency resonator whose frequency is designed to reduce automatically with time according to a preset frequency step.

More specifically, the determination means of the control module are suitable for setting successively the setpoint frequency Fc at a first value of the order of magnitude of the resonance frequency of the resonator without spark, at the moment t_0 of the triggering of the plasma generation command, and at a second value reduced by the predetermined frequency step relative to this first value, substantially at the moment t_d of the formation of the spark.

The setpoint frequency is, for example, reduced by a value of 50 kHz relative to an initial value corresponding to the value of the resonance frequency of the resonator without spark, at the instant t_d of the plasma generation command.

Thus, a system perfectly tuned upon the triggering of the plasma generation command is changed to a system that is "not quite" untuned at the moment of the formation of the spark, given that a reduction of the excitation frequency is provoked in order to take account of the formation of the spark to adapt the control of the resonator to the new resonance conditions, without, however, this reduction, whose value is preset, being correlated with the parameters of the actual spark.

Also, one variant provides for the adaptation of the excitation frequency to be optimized in real time during the plasma generation command, given the random variation of the parameters of the actual spark. More specifically, the determination means of the control module are then suitable for controlling the reduction of the setpoint frequency at the moment of the formation of the spark, according to a frequency step that is no longer preset, but, on the contrary, adjustable in real time according to the parameters of the actual spark.

Figure 3:
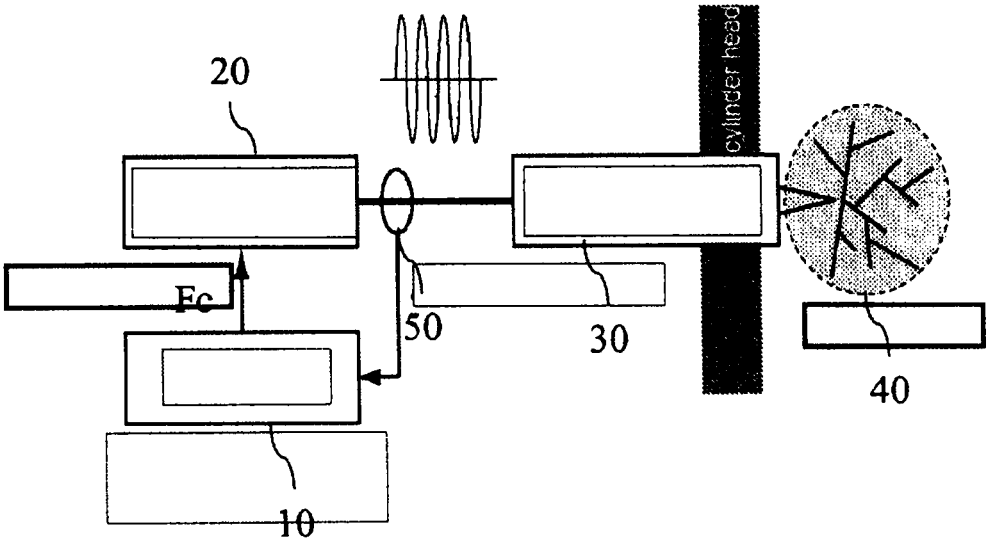
FIG. 3 illustrates one embodiment of a plasma generation device according to the invention.

For this, the device according to the invention comprises, with reference to FIG. 3, a resonator power supply electrical measuring module 50, connected to the control module 10.

Thus, for a setpoint frequency supplied, at the end of the transitional period t_d, the control module reads an electrical measurement representative of the formation of the spark (via a reception interface that is not represented) and then determines an optimum excitation frequency according to these electrical measurements, suited to the current resonance conditions with a spark formed. The electrical measurements can be used, for example, to determine the adjustable frequency step by which the setpoint frequency used as control frequency for the power supply module should be reduced in order to optimize in real time the resonant system as a whole.

The resonator power supply electrical measuring module is, for example, suitable for measuring the relative amplitude of the current at the input of the resonator. Thus, on each alternation, the amplitude of the current at the input of the resonator is checked and compared with the amplitude of the preceding alternation. If, at the end of the transitional phase t_d in which the spark is formed, a drop in the current is observed (due to the formation of the spark), the setpoint frequency supplied to the power supply module is then reduced by a frequency step determined in real time according to the measured current drop, so that the radiofrequency power supply of the resonator is adapted in real time to the current resonance conditions of the device as a whole.

A number of mathematical algorithms for optimizing resonant systems exist and can be used for this purpose.

The device according to the invention therefore makes it possible to maintain the maximum quality factor of the radiofrequency spark plug, regardless of its operating conditions. The proposed solution is easy to produce, inexpensive and makes it possible to control the power supplies for the radiofrequency plugs in real time and cylinder by cylinder.

The invention claimed is:

1. A radiofrequency plasma generation device, comprising:

a power supply module applying, to an output interface, an excitation signal at a setpoint frequency, that can enable formation of a spark at an output of a plasma generation resonator connected to the output interface of the power supply module; and a control module supplying the setpoint frequency to the power supply module in response to a radiofrequency plasma generation command, in which the control module comprises means for adapting the setpoint frequency to resonance conditions of the device after formation of the spark, and for setting the setpoint frequency at a value below the resonance frequency of the resonator without spark, wherein the control module is further configured to control the power supply module, so that it sends an excitation train to the radiofrequency resonator whose frequency can reduce automatically with time according to a preset frequency step.

2. The device as claimed in claim 1, wherein the difference between the set value and the resonance frequency of the resonator without spark is located within a range between 0 and 100 kHz.

3. The device as claimed in claim 1, wherein the means for adapting the setpoint frequency is configured to modulate the setpoint frequency for a duration of the plasma generation command.

4. The device as claimed in claim 3, wherein the means for adapting the setpoint frequency is configured to successively set the setpoint frequency at a first value of an order of magnitude of the resonance frequency of the resonator without spark, at a moment when the plasma generation command is triggered, and at a second value reduced by a predetermined frequency step relative to the first value, substantially at a moment of formation of the spark.

5. The device as claimed in claim 3, wherein the means for adapting the setpoint frequency is configured to control a reduction of the setpoint frequency from a set first value, according to a frequency step that can be adjusted in real time, from a moment of formation of the spark.

6. The device as claimed in claim 5, wherein the set first value is of an order of magnitude of the resonance frequency of the resonator without spark.

7. The device as claimed in claim 5, further comprising a resonator power supply electrical measuring module connected to the control module, the determination means determining the value of the frequency step according to electrical measurements received.

8. The device as claimed in claim 7, wherein the resonator power supply electrical measuring module is configured to measure relative amplitude of current at an input of the resonator.

9. An internal combustion engine ignition system, comprising at least one plasma generation device as claimed in claim 1.

* * * * *